US006102687A

United States Patent [19]

Butcher et al.

[11] Patent Number: 6,102,687

[45] Date of Patent: Aug. 15, 2000

[54] SIMPLIFIED CONFIGURATION FOR THE COMBUSTOR OF AN OIL BURNER USING A LOW PRESSURE, HIGH FLOW AIR-ATOMIZING NOZZLE

[75] Inventors: Thomas A. Butcher, Port Jefferson; Yusuf Celebi, Middle Island, both of N.Y.; Leonard Fisher, Colrain, Mass.

[73] Assignee: U.S. Department of Energy, Washington, D.C.

[21] Appl. No.: 09/161,814

[22] Filed: Sep. 28, 1998

[51] Int. Cl.[7] ..... F23D 14/70; F23D 14/48

[52] U.S. Cl. ..... 431/115; 431/353; 431/265; 239/431; 239/433

[58] Field of Search ..... 431/9, 115, 265, 431/353, 158, 116, 8; 126/91 A; 239/429, 431, 430, 433, 434, 423

[56] References Cited

U.S. PATENT DOCUMENTS

| | | | |
|---|---|---|---|
| 2,531,538 | 11/1950 | Smith . | |
| 3,070,150 | 12/1962 | Hunter et al. . | |
| 3,749,548 | 7/1973 | Zink et al. | 431/115 |
| 3,852,022 | 12/1974 | Medeot et al. . | |
| 4,014,639 | 3/1977 | Froehlich | 431/353 |
| 4,098,255 | 7/1978 | Nowak et al. | 126/91 A |
| 4,162,888 | 7/1979 | Weishaupt et al. . | |
| 4,285,664 | 8/1981 | Voorheis . | |
| 4,404,931 | 9/1983 | Smith et al. | 431/265 |
| 4,681,533 | 7/1987 | Petersen et al. | 431/115 |
| 4,815,966 | 3/1989 | Janssen | 431/115 |
| 5,085,577 | 2/1992 | Muller . | |
| 5,667,376 | 9/1997 | Robertson et al. | 431/353 |

*Primary Examiner*—Ira S. Lazarus
*Assistant Examiner*—Sara Clarke
*Attorney, Agent, or Firm*—Joy A. Alwan; Thomas G. Anderson; William R. Moser

[57] ABSTRACT

The invention relates to clean burning of fuel oil with air. More specifically, to a fuel burning combustion head using a low-pressure, high air flow atomizing nozzle so that there will be a complete combustion oil resulting in a minimum emission of pollutants. The inventors have devised a fuel burner that uses a low pressure air atomizing nozzle. The improved fuel burner does not result in the use of additional compressors or the introduction of pressurized gases downstream, nor does it require a complex design.

9 Claims, 3 Drawing Sheets

SIMPLIFIED CONFIGURATION FOR THE COMBUSTOR OF AN OIL BURNER USING A LOW PRESSURE, HIGH FLOW AIR-ATOMIZING NOZZLE

CONTRACTUAL ORIGIN OF THE INVENTION

The U.S. Government has rights in this invention pursuant to Contract No. DE-AC02-76CH00016 between the U.S. Department of Energy and Associated Universities.

BACKGROUND OF INVENTION

The invention relates to burning fuel more specifically, to a fuel burning combustion head using a low-pressure, high flow atomizing nozzle so that there will be a complete combustion resulting in a minimum emission of pollutants.

For many years researchers have attempted to develop fuel burners which reduce emissions caused by unburned fuel. It has been discovered that a complete combustion of the fuel reduces emissions of pollutants particularly carbon monoxide, hydrocarbons, and soot. In burning liquid fuels, the problem is to provide sufficient oxygen for complete combustion of the carbon and hydrogen in the fuel to carbon dioxide and water, without high levels of excess air, which leads to reduced operating efficiency. This has led to an understanding that along with complete mixing, flame temperature and residence time affect the emissions levels released into the atmosphere. As a result burners have been developed with a longer residence time and a lower flame temperatures (blue flame). The prior art includes devices using fuel pressure atomizing recirculating burners (using no combustion air for atomization), high pressure air atomizing burners which use only a very small fraction of combustion air for atomization, and low pressure air atomizing burners which use a small percentage of the combustion air for atomization.

U.S. Pat. No. 2,531,538 discloses a fuel burner using pressurized fuel and having an air control unit that can control the amount of swirl in the air.

Another example is shown in U.S. Pat. No. 3,070,150, here the burner uses a low pressure, air atomizing nozzle however only a small fraction of the air is actually introduced through the atomizer. Most of the air is introduced in the combustion zone downstream through a complex series of ports.

U.S. Pat. Nos. 3,852,022 and 4,162,888 use oil pressure atomizing nozzles typical of all modem home oil burners. The combustion air in these burners is split into two parts; the first at the primary flame zone and the remainder to complete combustion.

U.S. Pat. No. 4,285,664 discloses a fuel oil burner using bluff bodies to generate turbulent wake flows. These wake flows help to mix the fuel and air and stabilize the flame. Only the fuel is pressurized and atomized for ignition.

U.S. Pat. No. 5,085,577, shows a pressurized fuel atomizing nozzle having a toroidal recirculating apportionment of air between the primary and secondary zones.

What is needed but not provided in the prior art is a fuel burner having the combination of a low pressure atomizing nozzle which uses all of the combustion air to atomize the fuel. The advantages of having this configuration would be the ability of the fuel burner to operate at low firing rates to more finely atomize the fuel, to premix the air and fuel sooner, eliminates the need for air compressors, eliminate the need for complex and costly flow baffles and channels to mix additional air and thus, creating a reduction in cost and complexity of the fuel burner. Finally, it would result in a lower electric power requirement, a cleaner burn, and a significant reduction in the release of pollutants.

SUMMARY OF THE INVENTION

The present invention relates to burning fuel oil; more specifically, to a fuel oil burning combustion head using a low air pressure, high air flow atomizing nozzle so that there will be a complete combustion resulting in a minimum emission of pollutants. The inventors have overcome the problems remaining from the prior art by devising a fuel oil burner that uses a low air pressure, high air flow atomizing nozzle. A high speed fan or other means may be used to achieve the required air pressure, and special low pressure, air atomizing nozzle creates the air pressure required to achieve good combustion performance in the range of 3 inches of water to 7 inches of water.

The advantages of the present invention are that it uses essentially all of the combustion air to atomize the fuel and with a head configuration which produces recirculation.

It is one object of the invention to provide a fuel oil burner with the ability to operate at a low firing rate. The improved fuel burner does not result in the use of a high pressure fuel pump, an additional air compressor, or the introduction of pressurized gases downstream, nor does it require a complex design with higher cost.

It is further object of the present invention to provide such a fuel oil burner that does not require an air compressor.

It is a further object of the present invention to provide such an apparatus with an arrangement where the combustion gas recirculation provides a complete burn with reduced flame zone peak temperature resulting in a reduced pollutant emission into the atmosphere.

It is another object of the invention to completely eliminate both secondary and tertiary air flows.

It is a further object of the present invention to provide such a fuel burner that has a simple design thereby resulting in reduced cost of manufacture.

Other features and advantages of the present invention will be apparent from the following description in which the preferred embodiments have been set forth in conjunction with the accompanying drawings

BRIEF DESCRIPTION OF THE DRAWINGS

In describing the preferred embodiments of the invention reference will be made to the series of figures and drawings briefly described below.

There may be additional structures described in the foregoing application which are not depicted on one of the described drawings. In the event such a structure is described but not depicted in a drawing, the absence of such a drawing should not be considered as an omission of such design from the specification.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Figure 1:
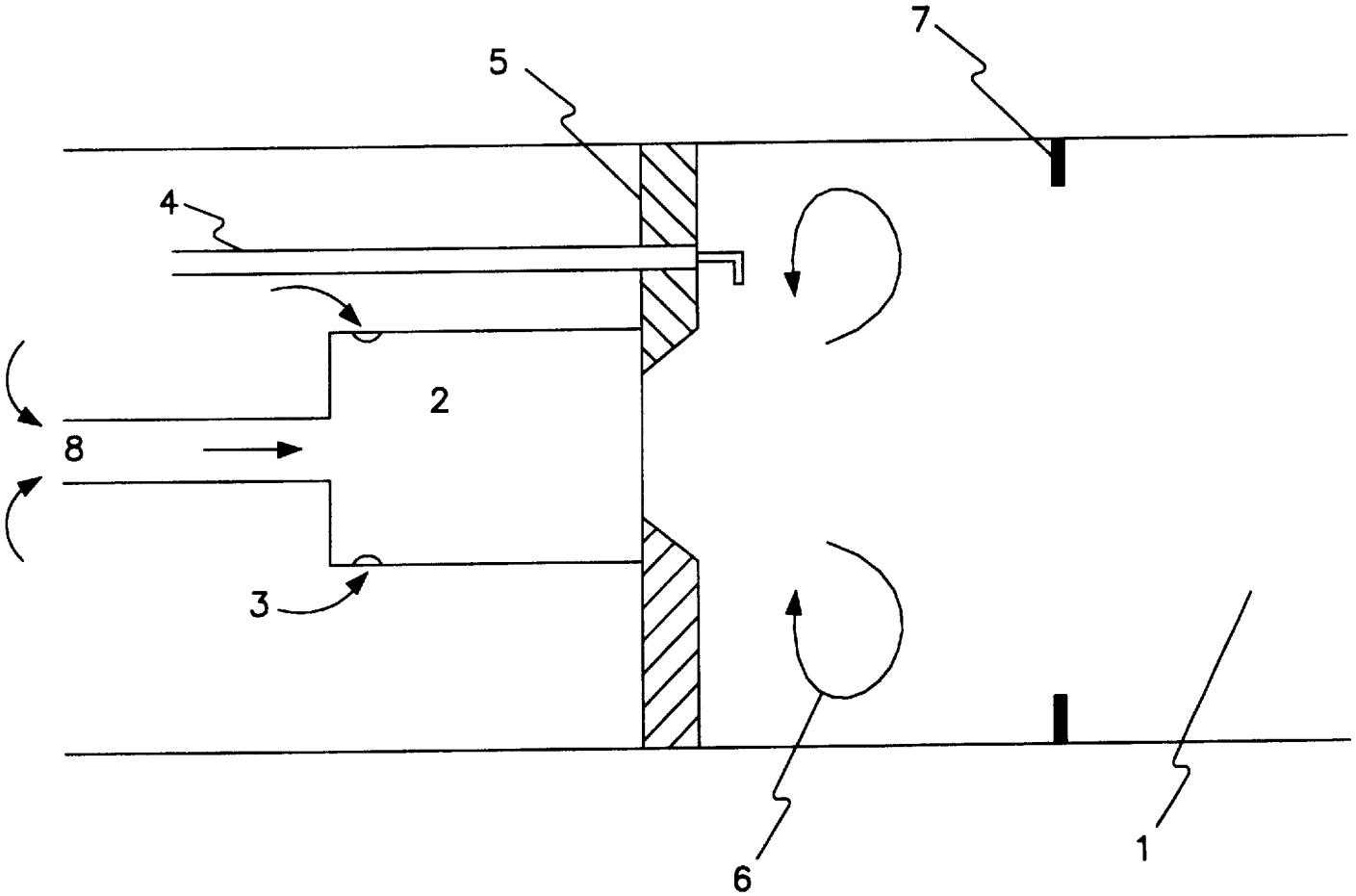
FIG. 1 depicts the fuel burner configuration as taught by the present invention.

As shown in FIG. 1 the oil fuel burner (1) comprises a burner flame tube low pressure air atomizer nozzle (2). Primary air enters the flame zone through the atomizer (2). The low pressure air entering at (3) and low pressure fuel (8) accelerate and swirl as they exit the atomizer (2) as a swirling air jet with a fine spray entrained. The retention plate (5), baffle plate (7) and flame tube (1) confine the expanding jet forcing a toroidal recirculation pattern. This recirculation zone (6) provides heat feedback necessary to stabilize the flame supplied by the ignition source (4). A strong flow in the recirculation zone (6) reduces the NOx emissions. The invention comprises a new and unique combination fuel burner which uses a low pressure air atomizer (2) to create the desired blue flame effect. In addition, it provides for a unique configuration which creates a swirling effect of the combustion gases. This swirling effect strongly influences the toroidal recirculation zone (6) leading to the recirculation into the flame of combustion products. The combustion products can be relatively cool and low in oxygen. The baffle plate (7) defines the boundary of the toroidal recirculation zone. The baffle plate (7) controls the fraction of gas in the recirculation zone which comes from outside of the flame tube. This improves the flames stability and lowers $NO_x$ emissions. The size of the baffle plate (7) controls flames intensity. A larger baffle generates a hotter, yellow flame and a more stable flame, while a smaller baffle plate creates a cooler bluer flame. The bluer, cooler flame is desired because it results in lower $NO_x$ emission. By controlling the size of the baffle plate, the length of the flame tube the burner can operate in either a blue or yellow flame mode.

Figure 2:
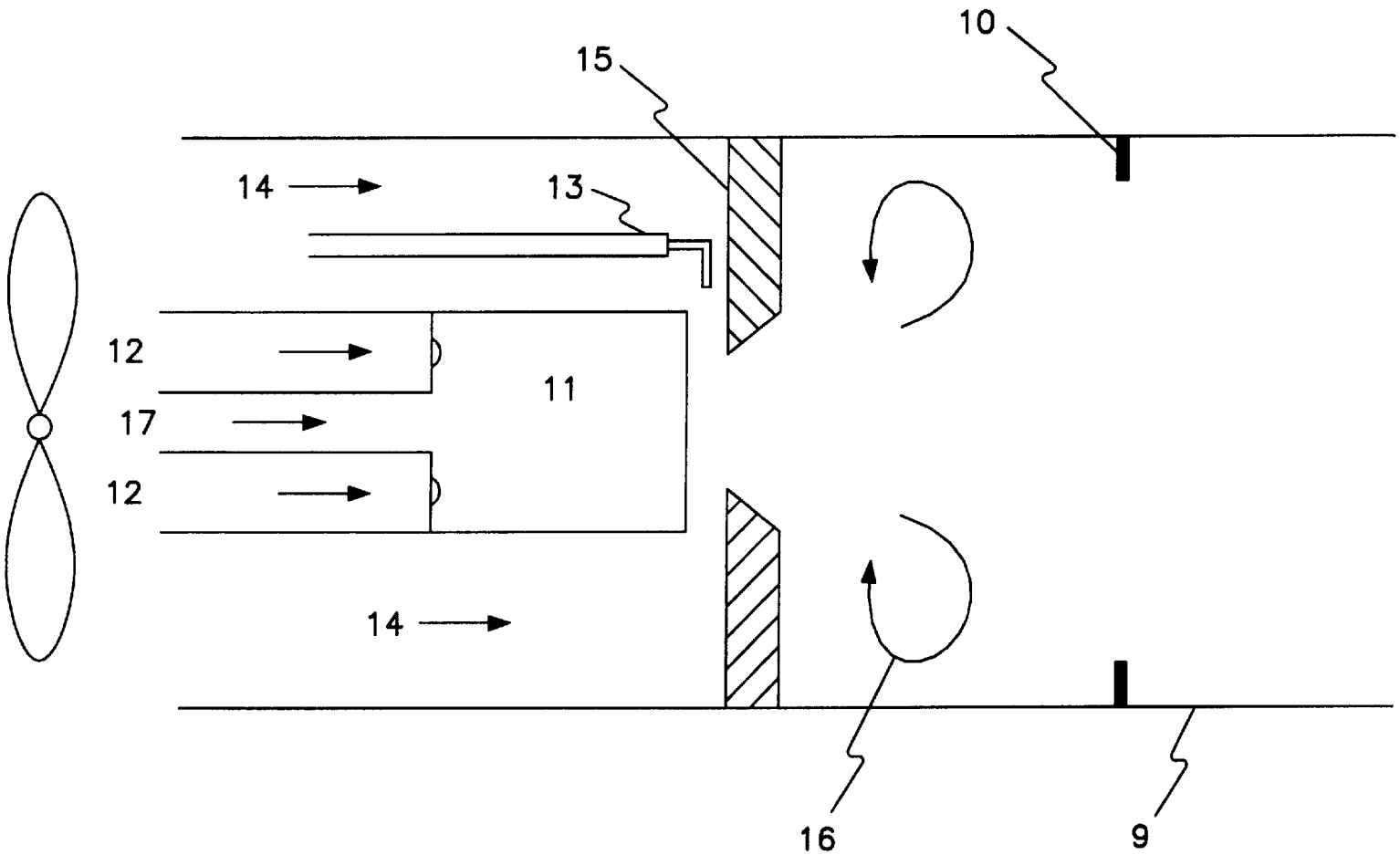
FIG. 2 depicts an alternative embodiment of the present invention.

An alternative embodiment is shown in FIG. 2. In this embodiment 80–95% of the combustion air enters at (12) in the back of the nozzle (11). A very small flow of secondary air (14) flows through the gap at the face of the nozzle (11). This air (14) keeps the nozzle (11) cooler and clear of any coke deposits. The small secondary air (14) may be supplied by a fan and it may be educted by the expanding jet flow from the nozzle (11). The low pressure primary air (12) and fuel (17) accelerate and swirl as they exit the nozzle (11), as a swirling air and sprayjet. This jet entrains the surrounding combustion gases inducing a torroidal vortex. The retention plate (15), baffle plate (10) and fuel burner walls (9) confine and strengthen the toroidal recirculation pattern. This recirculation zone (16) provides heat feedback necessary to stabilize the flame supplied by the ignition source (13). A strong flow in the recirculation zone (16) reduces the NOx emissions by entraining into the flame cooler, low-oxygen content gas from down-stream.

Figure 3:
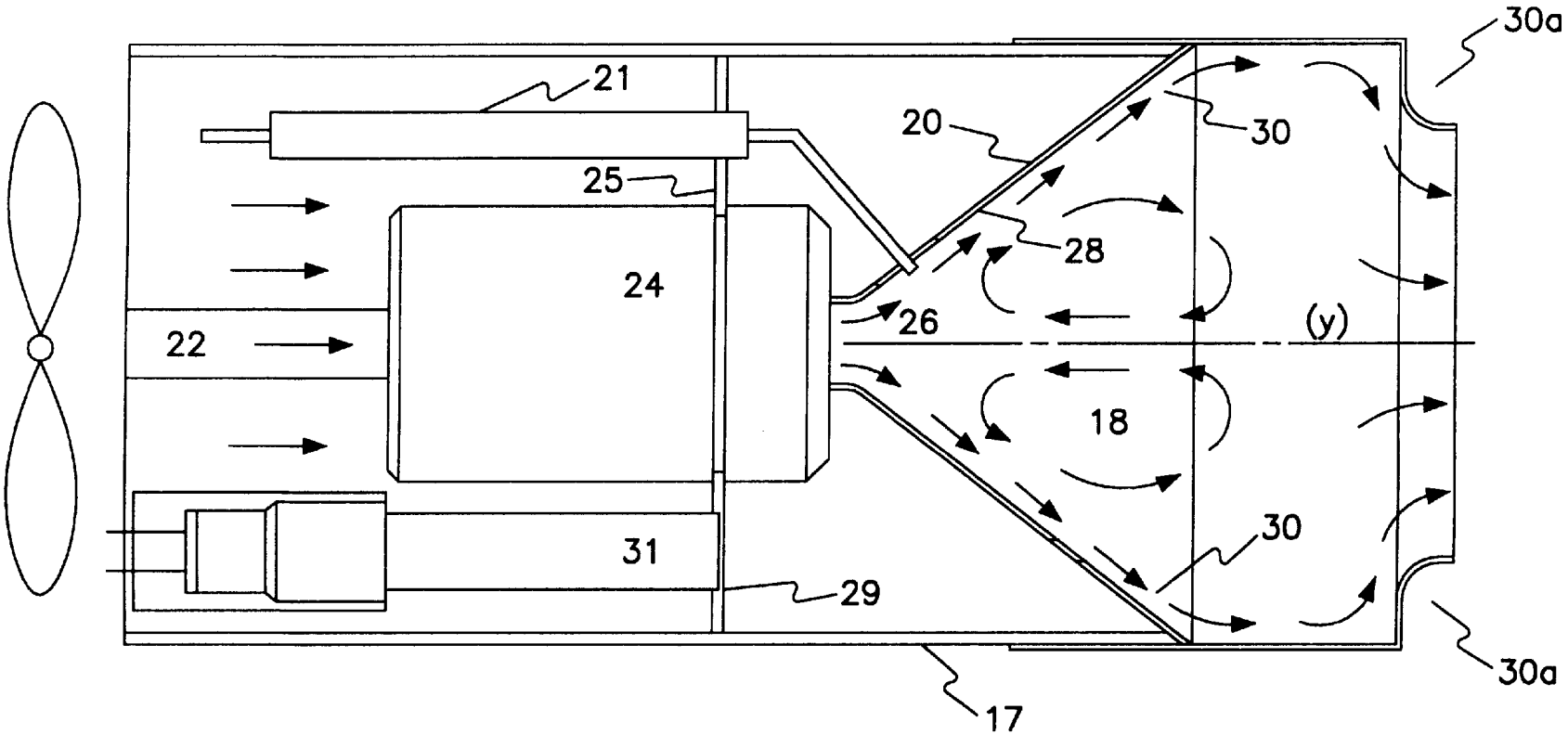
FIG. 3 depicts the invention having a conical shaped surface.

FIG. 3 shows an embodiment with a conical shaped surface (20) and the walls of the burner (30) serve to define the recirculation patterns (18). The conical walls (20) can be either a stainless steel cone or ceramic material. The electrode (21), nozzle (24), and flame sensor sight tube (31) are held in place by a centering plate (25) passing through the conical walls (20) and exiting through the ignition port (28) and sight port (29) respectively. The nozzle (24) exits the centering plate (25) and delivers a swirling jet of air and spray at (26). The conical surface (20) prevents the expanding jet from entraining combustion products from the outside, forcing the recirculation zone (18) internally along the axis (y). The fuel (22) and air enter the nozzle (24) disposed in the air tube (17) and accelerate and swirl as they exit the nozzle (24) at (26). The conical surface (20) and the walls of the burner **(30*a*) force a toroidal recirculation pattern (18) causing a reverse flow of hot gasses toward the nozzle exit (26)** along the axis (y).

Further modification and variation can be made to the disclosed embodiments without departing from the substance and spirit of the invention as defined in the following claims. Such modifications and variations, as included within the scope of these claims, are meant to be considered part of the invention as described.

What is claimed is:

1. A burner assembly for residential appliances comprising:

a flame tube attached to an air tube on one end and having a y-axis with one end of said air tube having an up flow area and the other end of said flame tube having a down flow area;

an atomizing nozzle disposed in said air tube and said atomizing nozzle having an air source for introduction of low pressure air and a fuel source for introduction of low pressure fuel;

an annular retention plate attached to the air tube to define a boundary of a recirculation zone;

an ignition source disposed within said air tube and located juxtapose to said nozzle for ignition of the fuel;

said fuel source and said air source positioned so that the air and the fuel expand as they pass through the atomizing nozzle entraining the air along the y-axis into the down flow area whereby said entrained air is ignited by said ignition source; and a baffle plate attached to said flame tube in the down flow area creating a recirculation zone between said retention plate and said baffle plate.

2. The apparatus as recite in claim 1 wherein said air source consists of air ducts in the atomizing nozzle.

3. The apparatus as recited in claim 2 wherein said ignitor is positioned so that it passes through and is held in place by the retention plate and whereby an ignition will occur in said down flow area releasing a combustion gas.

4. The apparatus as recited in claim 3 wherein said atomizing nozzle abuts one side of said retention plate.

5. The apparatus as recited in claim 4 wherein said baffle plate is located at a distance in said flame tube so that said combustion gas is recirculated in the recirculation zone stabilizing the flame and thereby creating a blue flame.

6. The apparatus as recited in claim 1 wherein said air source consist of pressurized air entering the nozzle with 20–40% of said air creating a secondary source which surrounds the atomizing nozzle and ignition source.

7. The apparatus as recited in claim 6 wherein said ignitor is positioned between the nozzle and retention plate and whereby an ignition will occur between said atomizing nozzle and the retention plate releasing a combustion gas to said down flow area.

8. The apparatus as recited in claim 7 wherein said retention plate is distanced from said atomizing nozzle and said baffle plate is located at a distance in said flame tube so that said combustion gas is recirculated in the recirculation zone stabilizing the flame and thereby creating a blue flame.

9. The apparatus as recited in claim 8 wherein said pressurized air is generated by a fan located in said up flow area.

* * * * *